United States Patent [19]

Chia

[11] 4,372,542

[45] Feb. 8, 1983

[54] COPPER SLAG TRAP

[75] Inventor: E. Henry Chia, Carrollton, Ga.

[73] Assignee: Soutwire Company, Carrollton, Ga.

[21] Appl. No.: 275,554

[22] Filed: Jun. 19, 1981

[51] Int. Cl.[3] ..... B22D 43/00

[52] U.S. Cl. ..... 266/229; 75/76; 75/93 R

[58] Field of Search ..... 266/227, 229, 230, 231, 266/233; 75/68 R, 93 R, 63

[56] References Cited

U.S. PATENT DOCUMENTS

| | | | |
|---|---|---|---|
| 2,968,847 | 1/1961 | Bergmann | 22/83 |
| 3,599,319 | 8/1971 | Weinstein et al. | 29/527.6 |
| 3,632,335 | 1/1972 | Worner | 75/63 |
| 4,007,923 | 2/1977 | Chia | 266/217 |

*Primary Examiner*—L. Dewayne Rutledge
*Assistant Examiner*—Christopher W. Brody
*Attorney, Agent, or Firm*—Herbert M. Hanegan; Stanley L. Tate; Robert S. Linne

[57] ABSTRACT

Disclosed are apparatus for and a method of continuously trapping slag during molten copper transfer wherein a refractory slag trap comprising baffles traps slag particles by providing areas of non-uniform flow within the molten copper melt thereby causing all constituents having a specific gravity less than that of molten copper to rise to the surface of the molten copper and form agglomerates which can be easily separated from the copper by a pseudodeconting procedure or by other manual means.

17 Claims, 1 Drawing Figure

COPPER SLAG TRAP

BACKGROUND OF THE INVENTION

1. Field of the Invention

The present invention relates generally to the treatment of molten copper metal, and specifically to apparatus for and a method of continuously deslagging molten copper to extract impurities therefrom.

2. Description of the Prior Art

U.S. Pat. Nos. 2,429,584, 3,537,987, 3,610,600, 3,820,767, 3,904,180, 3,972,709, 4,067,731, and references therein are among numerous patents illustrating that treating and deslagging molten metal are generally well known in the prior art. Applicant believes that until the present invention, there has been no effective system for continuously deslagging molten copper.

The majority of molten metal treating technology has focused on aluminum, partly because purity is particularly critical in aluminum and partly because the relatively low melting temperature of aluminum makes it much easier to treat than most metals. Molten aluminum treatment has progressed from batch-type slag filtering and fluxing, through in-line granular and woven refractory filtering and fluxing, to the in-line use of disposable porous ceramic foam filters such as those disclosed in U.S. Pat. Nos. 4,007,923, 3,917,242, 3,893,917, 3,962,081 and 4,092,153. Other metals, including cast iron and steel, are often degassed by a vacuum using reactive ingredient methods, while molten copper treatment technology has been limited to few improvements, one being the use of catalytic action to deoxidize a melt.

Three major grades of copper recognized in the molten copper treatment industry are tough pitch copper, fire-refined copper and electrolytic copper. As used herein these terms are given what is believed to be their usual and common meanings in the industry as defined in Volume 1 of Metals Handbook, Eighth Edition published in 1961 by the American Society for Metals. Tough pitch copper is: "Copper containing from 0.02 to 0.05% oxygen, obtained by refining copper in a reverberatory furnace." Electrolytic copper is: "Copper which has been refined by electrolytic deposition, including cathodes which are the direct product of the refining operation, refinery shapes cast from melted cathodes, and by extension, fabricators' products made therefrom. Usually when this term is used alone, it refers to electrolytic tough pitch copper without elements other than oxygen being present in significant amounts." Fire-refined copper is: "Copper which has been refined by the use of a furnace process only, including refinery shapes and, by extension, fabricators' products made therefrom. Usually, when this term is used alone it refers to fire-refined tough pitch copper without elements other than oxygen being present in significant amounts."

Most manufacturers of cast copper products rely solely on the inherent purity of electrolytically refined copper for production of high quality castings. For molten copper known to be contaminated by refractories or the like, the present alternative to accepting a poor quality product is scrapping the product for remelting. Contamination of the copper melt can occur when steel strapping, normally used to bundle cathodes for shipment, is inadvertently charged into a melting furnace along with the cathodes. Products produced from such a melt would of necessity be scrapped and again refined into cathode. Use of the present invention immediately prior to casting eliminates duplication of refining effort. Thus, a higher percentage of superior quality cast products can be produced from a typical melt at less overall cost cast bar.

It is a generally accepted principle of the casting arts that the quality of a cast product is more related to the particle size of inclusions dispersed in the metal matrix than to the number of inclusions. This is particularly true when the casting is intended to be rolled into rod which will ultimately be drawn into wire for use in electrical conductor, magnet wire or telephone wire. When copper rod containing an inclusion is drawn to a point fine enough that the inclusion's diameter becomes significant with respect to the diameter of the wire a reduction in effective cross-sectional area is produced. Those in the art assume that a wire break will occur when the inclusion diameter "d" becomes an appreciable fraction of the "downstream" wire diameter. It is also generally assumed in the wire making industry that there exists a critical inclusion size "$d_c$" for a given "downstream" wire diameter and that the condition for a break is: $d \geqq d_c$. Thus, it is apparent that, there is a need for apparatus for and a method of controlling the diameter of inclusions cast into the matrix of copper castings intended for use in the copper wire industry. A detailed analysis of this problem of the wire industry is found in "Wire Breaks In Copper: A Classification and Analysis"; Chia et al; *Wire Journal,* February, 1976.

Fire refined copper often contains many metallic and nonmetallic impurities which are detrimental to finished products made directly from fire refined copper such as wire. When fire refined copper is cast into anodes for electrolytic refining, these impurities result in heavy accumulations of waste sludge in the electrolytic reservoirs or cells. Use of the present invention improves quality of fire refined copper thereby making it acceptable for many applications without additional refining, and reduces impurities in cast anodes destined for electrolytic refining.

Another problem often occuring in the prior art is clogging of the tundish spout. The ceramic spout disclosed in U.S. Pat. No. 3,752,372 is representative of the type of spouts used to cast molten copper. Molten copper will not wet or stick to a spout of this type; however, certain impurities and contaminants such as iron will accumulate on the surface of the spout, forming agglomerates which increase in size as copper flows through the spout and which eventually clog the spout completely interrupting the flow of molten metal into the casting mold being fed by the spout. By lowering the amount of these impurities and contaminants in the melt through the application of the present invention, this problem is substantially reduced.

SUMMARY OF THE INVENTION

The present invention solves many problems caused by contamination during processing of, e.g. molten electrolytically refined copper, by serving as a final slag trap which removes solid contaminants introduced into the molten metal by the process itself as well as slag forming metallic and nonmetallic impurities such as iron and calcium. In addition it improves the quality of fire refined copper. This invention is an apparatus for and a method of continuously deslagging molten copper comprising, in its basic sense, a refractory slag trap having a plurality of baffle configurations to trap slag during molten metal transfer based on the difference in density between the molten copper and the existing slag particles.

Thus one object of the present invention is to provide an apparatus for and a method of deslagging continuously flowing molten copper.

A further object of this invention is to provide an apparatus for and a method of improving the quality of continuously cast copper products by providing precautionary deslagging of melted electrolytically refined copper immediately before final casting into a product.

Yet another object of the present invention is to provide an apparatus for and a method of improving the quality of fire refined copper, reducing impurity related problems in electrolytic refining of copper and reducing the need for further refining in other applications.

Still another object of the present invention is to provide apparatus for and a method of reducing the particle size of refractory impurities sometimes found in the metal matrix of copper castings. Another object of the present invention is to provide apparatus for and a method of providing a cast copper product with substantially evenly distributed inclusions throughout the metal matrix. Another object of this invention is to provide apparatus and method for discouraging submersion of slag particles in molten copper by inhibiting uniformity of melt flow, decreasing velocity of melt flow, and providing obstacles to slag particles whereby slag particles are encouraged to rise to the surface of the molten metal.

A further object of the present invention is to provide apparatus for and a method of continuously removing impurities trapped by the present inventiion without interrupting the flow of molten metal and without interrupting continuous casting operations.

BRIEF DESCRIPTION OF THE DRAWING

While the specification concludes with claims particularly pointing out and distinctly claiming the subject matter which is regarded as the invention, it is believed that the invention, objects, features and advantages thereof will be better understood from the following description taken in connection with the accompanying drawing, FIG. 1, which is a schematic sectional view of the present invention.

DESCRIPTION OF THE PREFERRED EMBODIMENT

Figure 1:
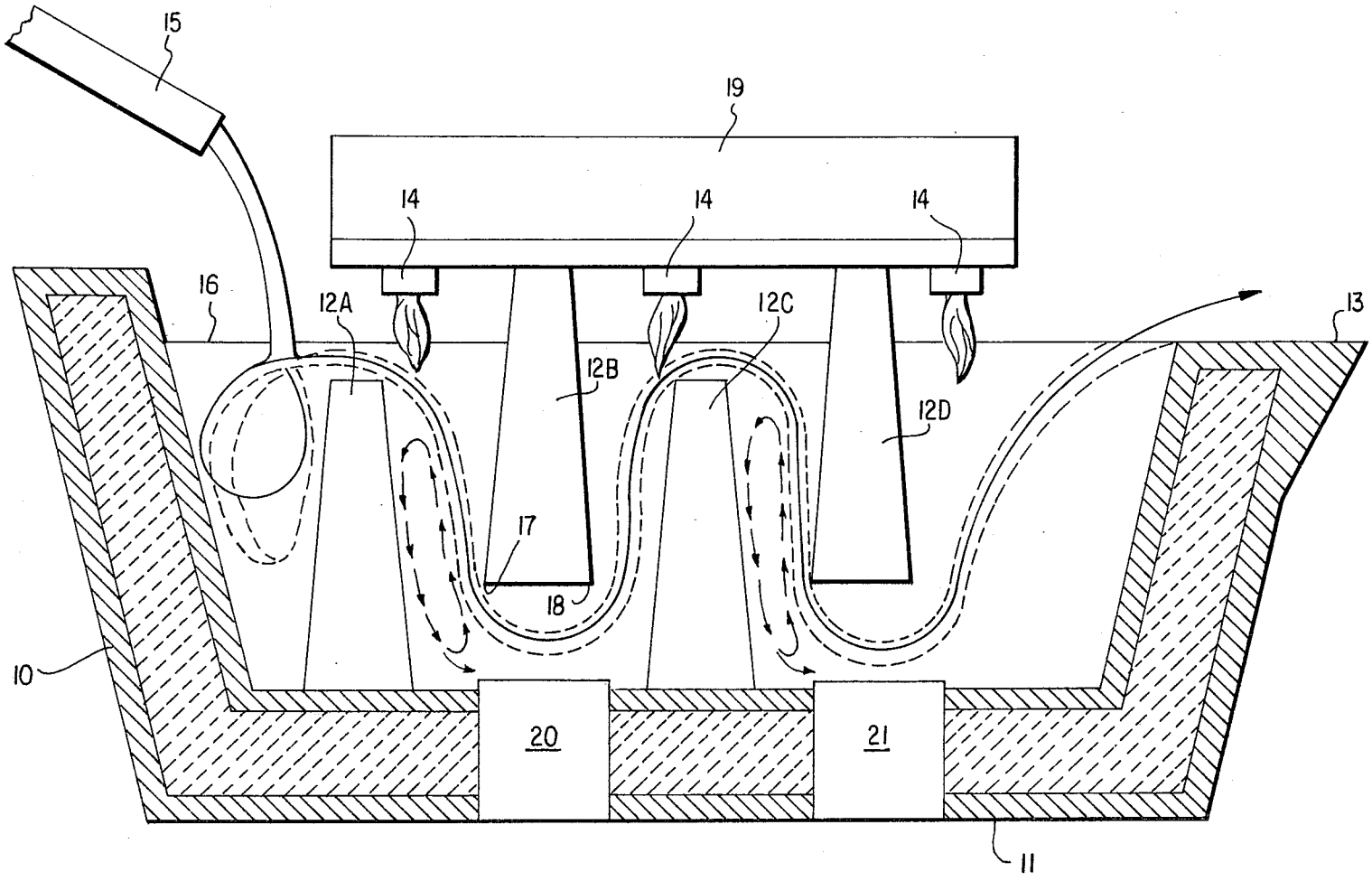

Slag emmersed in molten copper is usually composed of the following particles having corresponding density in g/cc of $Cu_2O$[6.0], $Fe_2O_3$[5.2], FeO[5.7], $Fe_3O_4$[5.2], $SiO_2$[2.2], $Al_2O_3$[3.9] and CuO[6.4] while molten copper has a substantially higher density of 8.93 g/cc. Slag particles will therefore generally not be submerged by their own weight in a copper melt, instead, they invariably float to the top of a still body of molten copper. Where molten copper is continuously required to feed a manufacturing process such as a system for the continuous casting of copper bar by a conventional wheel and belt type caster, however, the copper must continuously flow from the melter to the casting machine and the current produced by the flowing metal catches and carries along with it slag particles that would otherwise rise to the surface of the metal and be removed. The present invention operates to create areas of little or no melt flow and areas of turbulent flow thereby causing slag parties to be released from the molten metal current and allowing it to rise to the surface of the flowing metal for easy removal.

Referring now in detail to the drawing, there is illustrated in FIG. 1 a tundish 11 having a bottom and four sides for containing a melt. Tundish 11 is positioned between a melting or refining furnace (not shown) and a continuous or semi-continuous casting machine (not shown). Molten copper, usually above 2000° F., is poured into one end (left end of FIG. 1) of the tundish 11 through the open top and flows toward a pouring spout 13, located in the opposite end. Disposed along the melt flow path are a plurality of burners 14 which inject heat therein to maintain proper melt temperature.

Between the entrance spout 15 and the exit spout 13, the present invention provides a plurality of obstacles which discourage submersion of slag, decrease melt velocity and inhibit flow uniformity. The obstacles comprise a plurality of baffles 12 disposed in the flow path (current) of the molten copper. Each baffle 12 has an inverse trapezoidal shape having an enlarged base. The baffles 12 are sequentially mounted to the bottom of the tundish 11 and to a top member of the tundish 19 so that upward extending baffles 12 restrict the melt flow path to a small space between the top of the baffles 12 and the surface of the molten copper while baffles 12 extending downward into the melt restrict the molten copper flow path to small space between the bases of the baffles 12 and the inside bottom surface of the tundish 11. In this manner a series of restriction chambers are provided having turbulence producing entrances and exits to discourage slag from entering the molten metal flow path by encouraging the slag to float in the upper entrance of a restriction chamber.

In operation, the slag bearing molten metal is poured into the slag trap 10 by the entrance spout 15. It is preferred to place the pouring end of entrance spout 15 relatively close to the slag trap 10 to avoid undue spashing but far enough above the normal molten metal level 16 to create substantial turbulence within the melt as the molten metal enters trap 10 to initiate non-uniform melt flow. As FIG. 1 illustrates, the melt is channeled to flow over the top of the first baffle 12A which is from about one quarter inch to about one inch but preferrably about one half inch below the normal melt level 16. By forcing all of the melt to flow over the top of the first baffle 12A, all of the slag is directed upward. As the slag nears the surface it tends to remain near the surface because of its lower specific gravity. In addition, the relatively high surface tension of the accumulating slag discourages slag particles from re-entering the melt flow once they have become part of the slag accumulation. Slag particles which do not remain near the surface are relatively small because the force of the molten copper flow drawing them is relatively small. As the molten copper travels over the first baffle 12A it begins to descend in the space between the first baffle 12A and the second baffle 12B. As the copper descends, the inverse trapezoidal configuration of the baffles 12A, 12B and 12C continuously restricts copper flow to cause non-uniform copper flow thereby preventing slag particles from being drawn downward. As the copper clears the first bottom edge 17 of the second baffle 12, flow restriction reaches a maximum. While traveling from the first bottom edge 17 of the second baffle 12B to the second bottom edge 18 of the second baffle 12B, restriction is constant. While this constant restriction may be the maximum restriction, it is preferred that the shortest distance between the bottom of the second baffle 12B and the top inner surface of the bottom of tundish 11 be greater than the shortest distance between the first edge 17 of the second baffle 12B and the first baffle 12A. Thus an area of relatively unrestricted flow is promoted below the second baffle 12B to enhance nonuniformity of copper flow. As copper flow reaches the second bottom edge 18 of the second baffle 12B flow is suddenly restricted to maximum again and gradually decreased as the copper flows upward between the second baffle 12B and the third baffle 12C. The cycle of promoting floating of slag particles and discouraging sinking of slag particles by sequentially providing unrestricted flow, gradual restriction, relatively light restriction, sudden restriction and gradual return to unrestricted flow is repeated between the third and fourth baffles 12C and 12D to prevent passage of slag through the exit spout 13. While only four baffles are shown, modules of similar construction may be added to repeat the cycle until the slag content of the metal is reduced to an acceptable level. To increase the rate at which slag particles are removed from the molten metal flow, a variable amplitude transducer 20 may be mounted in the bottom of trap 10 and used to further increase the turbulence created by baffles 12. Ultrasonic waves set up in the molten metal by transducer 20 progress upward from their source transducer 20 thereby providing an upward force which propels slow particles upward through the molten to the surface thereof. This motion either perpendicular to or counter to the direction of melt flow is further assisted by convection currents in the melt caused by thermal gradients induced in the metal by uneven application of heat from burners 14 and 21. In each cycle, progressively smaller quantities of slag having progressively smaller particulate size are permitted to remain in the stream of copper until substantially all of the detrimental slag is removed from the melt.

I claim:

1. A copper slag trap for continuously trapping slag during transfer of molten copper from a melting means to a casting means comprising:

(a) a tundish having a bottom and sides adapted to receive a molten metal melt through a melt entrance and to maintain said melt as the melt flows through said tundish to a melt exit;

(b) a top member positioned above said tundish; and (c) at least two melt flow obstacles situated above said tundish bottom, below said top member, and between said entrance and said exit, said obstacles being adapted to project into said melt flow in a predetermined pattern and alternately restrict and release said melt flow to induce non-uniform flow patterns therein thereby causing slag particles trapped in the molten metal matrix to rise to the surface of the molten metal.

2. The apparatus of claim 1 wherein said obstacles are sequentially mounted to the bottom and sides of the tundish and then to the top member and sides of the tundish in such a manner that the melt is sequentially required to flow over a bottom mounted obstacle and under a top mounted obstacle.

3. The apparatus of claim 1 wherein said top member further includes at least one burner for injecting heat into the melt.

4. The apparatus of claim 1 wherein the bottom of said tundish includes at least one heating means for applying heat to the molten metal in said tundish.

5. The apparatus of claim 1 wherein the bottom of said tundish includes means for setting up ultrasonic waves of varying amplitude in the melt whereby slag particles contained in the melt are carried in direction counter to the direction of melt flow and to the metal surface.

6. The apparatus of claim 2 wherein said obstacles further comprise a plurality of baffles of inverse trapezoidal configuration having enlarged bases and narrowed tops whereby the flow of molten copper is alternately restricted and released to induce nonuniform flow patterns whereby the less dense slag particles are discouraged from following the general copper melt flow direction and encouraged to separate from the molten metal matrix and form agglomerates on the surface thereof.

7. The apparatus of claim 6 wherein bottom mounted baffles extend upward to a level from about one quarter inch to about one inch below the normal melt level.

8. The apparatus of claim 7 wherein the bottom mounted baffles extend upward to a level about one half inch below the normal melt level.

9. The apparatus of claim 6 wherein flow restriction increases from an area above a first bottom mounted baffle and in front of a second top mounted baffle to maximum restriction in the area between the first bottom edge of the second baffle and the nearest portion of the first baffle; flow restriction is constant in the area between the bottom surface of the second baffle and the top inner surface of the bottom of the tundish; and flow restriction decreases from maximum restriction in the area between the second bottom edge of the second baffle and the nearest portion of the third bottom mounted baffle to minimize restriction in the area behind the second baffle and above the third baffle.

10. The apparatus of claim 9 wherein constant restriction below the bottom surface of the second baffle is less than maximum because the distance between the bottom surface of the second baffle and the top inner surface of the bottom tundish is greater than either the distance between the first bottom edge of second baffle and the nearest portion of the first baffle or the distance between the second bottom edge of the second baffle and the nearest portion of the third baffle.

11. The apparatus of claim 10 adapted to cause at least two cycles of minimum flow restriction, gradual increase to maximum flow restriction, sudden decrease to constant flow restriction, sudden increase to maximum flow restriction, and gradual decrease to minimum flow restriction.

12. The apparatus of claim 11 wherein progressively smaller quantities of progressively smaller slag particles are permitted to remain in the melt stream by each cycle until substantially all detrimental slag is trapped and removed from the molten metal.

13. A copper slag trap for continuously trapping slag during transfer of copper from a melting means to a casting means, comprising:

(a) a tundish having a bottom and sides adapted to receive a molten metal melt through a melt entrance and to maintain said melt as the melt flows through said tundish to a melt exit;

(b) a top member positioned above said tundish; and (c) a plurality of melt flow obstacles which comprises a plurality of baffles of inverse trapezoidal configuration having enlarged bases and narrowed tops whereby the flow of the molten metal is alternately restricted and released to induce nonuniform flow patterns and the less dense slag particles are discouraged from following the general copper melt flow direction and are encouraged to separate from the molten metal matrix and form agglomerates on the surface thereof.

14. The apparatus of claim 13 wherein said baffles are sequentially mounted to the bottom and sides of the tundish and then to the top member and sides of the tundish whereby the melt is required to flow sequentially over a bottom mounted obstacle and under a top mounted obstacle.

15. The apparatus of claim 13 wherein said top member further includes at least one burner for injecting heat into the melt.

16. The apparatus of claim 13 wherein the bottom of said tundish includes at least one heating means.

17. The apparatus of claim 13 wherein the bottom of said tundish includes means for setting up ultrasonic waves of varying amplitude in the melt whereby slag particles contained in the melt are carried in a direction counter to the direction of melt flow and to the metal surface.

* * * * *